US010631082B2

(12) United States Patent
Litovsky et al.

(10) Patent No.: US 10,631,082 B2
(45) **Date of Patent: *Apr. 21, 2020**

(54) ACOUSTIC DEVICE HAVING AN ELECTRO-ACOUSTIC TRANSDUCER MOUNTED TO A PASSIVE RADIATOR DIAPHRAGM

(71) Applicant: Bose Corporation, Framingham, MA (US)

(72) Inventors: Roman N. Litovsky, Newton, MA (US); Chester Smith Williams, Lexington, MA (US); Michael Tiene, Franklin, MA (US)

(73) Assignee: Bose Corporation, Framingham, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/390,121

(22) Filed: Apr. 22, 2019

(65) Prior Publication Data

US 2019/0246201 A1 Aug. 8, 2019

Related U.S. Application Data

(63) Continuation of application No. 15/463,463, filed on Mar. 20, 2017, now Pat. No. 10,271,129.

(51) Int. Cl.
*H04R 1/28* (2006.01)
*H04R 1/26* (2006.01)

(52) U.S. Cl.
CPC ..... *H04R 1/2834* (2013.01); *H04R 1/26* (2013.01)

(58) Field of Classification Search
CPC ..... H04R 1/2834; H04R 1/227; H04R 3/00; H04R 1/22
USPC ..... 381/186, 349, 182, 345, 354
See application file for complete search history.

(56) References Cited

U.S. PATENT DOCUMENTS 5,850,460 A * 12/1998 Tanaka ..... H04R 1/2834 381/186
10,271,129 B2 * 4/2019 Litovsky ..... H04R 1/26
2006/0291687 A1 * 12/2006 Maekawa ..... H04R 1/2842 381/389
2009/0245561 A1 * 10/2009 Litovsky ..... H04R 1/2834 381/345
2010/0135516 A1 * 6/2010 Saiki ..... H04R 1/2811 381/386
2014/0193005 A1 * 7/2014 Riggs ..... H04R 5/02 381/300

(Continued)

*Primary Examiner* — Fan S Tsang
*Assistant Examiner* — Julie X Dang

(57) ABSTRACT

An acoustic device includes first and second acoustic cavities which are air tight. A first passive radiator includes a first passive radiator diaphragm that has a rear surface which is exposed to the first acoustic cavity. A second passive radiator includes a first passive radiator diaphragm having a front surface which is exposed to the first acoustic cavity, and a rear surface which is exposed to the second acoustic cavity. A first electro-acoustic transducer is supported on the second passive radiator diaphragm. The first electro-acoustic transducer is arranged such that a first radiating surface of the first electro-acoustic transducer radiates acoustic energy into the first acoustic chamber and a second radiating surface of the first electro-acoustic transducer radiates acoustic energy into the second acoustic chamber.

20 Claims, 2 Drawing Sheets

(56) References Cited

U.S. PATENT DOCUMENTS

2015/0281844 A1* 10/2015 Stabile ..... H04R 1/2834
381/345

* cited by examiner

ACOUSTIC DEVICE HAVING AN ELECTRO-ACOUSTIC TRANSDUCER MOUNTED TO A PASSIVE RADIATOR DIAPHRAGM

RELATED APPLICATIONS

This application is a continuation of U.S. application Ser. No. 15/463,463 filed Mar. 20, 2017, the contents of which are incorporated herein by reference.

BACKGROUND

This disclosure relates to an acoustic device having an electro-acoustic transducer mounted to a passive radiator diaphragm.

A major problem in making a loudspeaker system for low frequency reproduction is to obtain a high output at the low frequencies while limiting loudspeaker cone excursion to reasonable limits within a displacement region relatively free from audible distortion sufficiently limited so that the cost of making this region is not excessive.

Many prior art low frequency speaker systems comprise a simple woofer with no enclosure, as in television and radio sets and some public address systems. A difficulty with these systems is that there is no means for preventing the radiation from the back of the speaker from canceling the radiation from the front. Such a system has very large cone excursions at low frequencies if they attempt to produce low bass.

One prior art approach for reducing back radiation is to place the loudspeaker driver in a closed box to form what is often called an acoustic suspension system. An acoustic suspension system provides a reactance against which the loudspeaker driver works, limiting the excursion and also preventing the radiation from the back of the loudspeaker from canceling that from the front.

A ported system is one prior art approach to improving upon the acoustic suspension system. A ported system typically includes a woofer in the enclosure and a port tube serving as a passive radiating means. The air in the port tube provides an acoustic mass that allows system design with an extra reactance which can be used to tailor the frequency response at the low end. A ported system is characterized by a resonance (port resonance) at which the mass of air in the port reacts with the volume of air in the cabinet to create a resonance at which the cone excursion of the loudspeaker is minimized. A ported system exhibits improved sensitivity at port resonance and decreased cone excursion, thereby minimizing distortion. The result of the improved sensitivity at port resonance is frequently an extension of the lower cutoff frequency of the loudspeaker to a lower value.

U.S. Pat. No. 4,549,631 describes a ported loudspeaker system which has an enclosure with a baffle that divides the interior into first and second subchambers. Each subchamber has a port tube that couples the subchamber to the region outside of the enclosure. The dividing baffle carries a woofer. The result of this arrangement having two subchambers and two port tubes is to lower the cone excursion in the low frequency region from that which could be obtained with a standard ported system and also to provide an additional parameter value that may be adjusted for maximizing response in the low frequency region.

While ported enclosures may be suitable for larger systems, they may not be as practical for smaller, portable systems. In that regard, another acoustic element for extending low frequency cutoff of a speaker system is a passive radiator. Passive radiators are typically employed where extending low frequency range is desired in smaller, e.g., portable, speaker systems. However, merely replacing the ports of the dual chamber design of the '631 patent with passive radiators could have undesirable consequences, e.g., unbalanced forces on the enclosure. The result could be undesirable movement or vibration of the enclosure. This is not an issue with the ports because there the moving masses, which are just plugs of air trapped in the ports, are small.

SUMMARY

All examples and features mentioned below can be combined in any technically possible way.

In one aspect, an acoustic device includes first and second acoustic cavities which are air tight. A first passive radiator includes a first passive radiator diaphragm that has a rear surface which is exposed to the first acoustic cavity. A second passive radiator includes a first passive radiator diaphragm having a front surface which is exposed to the first acoustic cavity, and a rear surface which is exposed to the second acoustic cavity. A first electro-acoustic transducer is supported on the second passive radiator diaphragm. The first electro-acoustic transducer is arranged such that a first radiating surface of the first electro-acoustic transducer radiates acoustic energy into the first acoustic chamber and a second radiating surface of the first electro-acoustic transducer radiates acoustic energy into the second acoustic chamber.

Implementations may include one of the following features, or any combination thereof.

In some implementations, the acoustic device includes an enclosure that defines the first and second acoustic cavities.

In certain implementations, the acoustic device includes a third passive radiator comprising a third passive radiator diaphragm that has a rear surface which is exposed to the second acoustic cavity.

In some examples, the first passive radiator has a first effective radiating area; the second passive radiator has a second effective radiating area, inclusive of an effective radiating area of the electro-acoustic transducer; the third passive radiator has a third effective radiating area; and the first, second, and third effective radiating areas are substantially the same.

In certain examples, the first passive radiator diaphragm is coupled to the enclosure by a first suspension element, the second passive radiator diaphragm is coupled to the enclosure by a second suspension element, and the third passive radiator diaphragm is coupled to the enclosure by a third suspension element.

In some cases, the first passive radiator has a first effective mass and the first suspension element has a first effective stiffness; the second passive radiator has a second effective mass, inclusive of the mass of the electro-acoustic transducer, and the second suspension element has a second effective stiffness; the third passive radiator has a third effective mass and the third suspension element has a third effective stiffness; and the ratio of the first effective stiffness to the first effective mass is substantially equal to the ratio of the second effective stiffness to the second effective mass, which is substantially equal to the ratio of the third effective stiffness to the third effective mass.

In certain cases, the first effective mass is substantially less than the second effective mass.

In some implementations, the third effective mass is substantially less than the second effective mass.

In certain implementations, the first passive radiator diaphragm, the second passive radiator diaphragm, and the third passive radiator diaphragm are each configured to vibrate, relative to the enclosure, along a common vibration axis.

In some examples, the first electro-acoustic transducer includes a transducer diaphragm, a motor, and a surround that couples the transducer diaphragm to the second passive radiator diaphragm, and wherein the motor drives motion of the transducer diaphragm, relative to the second passive radiator diaphragm, along the common vibration axis.

In certain examples, the first passive radiator diaphragm and the second passive radiator diaphragm are each configured to vibrate, relative to the enclosure, along a common vibration axis.

In some cases, the first electro-acoustic transducer includes a transducer diaphragm, a motor, and a surround that couples the transducer diaphragm to the second passive radiator diaphragm. The motor drives motion of the transducer diaphragm, relative to the second passive radiator diaphragm, along the common vibration axis.

In certain cases, the audio device includes a first enclosure which defines the first acoustic cavity, and a second enclosure that defines the second acoustic cavity, and the first enclosure is mounted to the second passive radiator such that the first enclosure moves when the second passive radiator diaphragm vibrates.

In some implementations, the first passive radiator diaphragm is coupled to the first enclosure by a first suspension element such that the second passive radiator diaphragm can vibrate relative to the first enclosure, and the second passive radiator diaphragm is coupled to the second enclosure by a second suspension element such that the second passive radiator diaphragm can vibrate relative to the second enclosure.

In certain implementations, the acoustic device includes a third acoustic cavity that is substantially air tight. A third passive radiator includes a third passive radiator diaphragm having a rear surface which is exposed to the third acoustic cavity. A fourth passive radiator including a fourth passive radiator diaphragm having a front surface which is exposed to the third acoustic cavity, and a rear surface which is exposed to the second acoustic cavity. A second electro-acoustic transducer is supported on the fourth passive radiator diaphragm. The second electro-acoustic transducer is arranged such that a first radiating surface of the second electro-acoustic transducer radiates acoustic energy into the third acoustic chamber and a second radiating surface of the second electro-acoustic transducer radiates acoustic energy into the second acoustic chamber.

In some examples, a third enclosure that defines the third acoustic cavity, wherein the third enclosure is mounted to the fourth passive radiator such that the third enclosure moves when the fourth passive radiator diaphragm vibrates.

In certain examples, the third passive radiator diaphragm is coupled to the third enclosure by a third suspension element such that the third passive radiator diaphragm can vibrate relative to the third enclosure, and the fourth passive radiator diaphragm is coupled to the second enclosure by a fourth suspension element such that the fourth passive radiator diaphragm can vibrate relative to the second enclosure.

In some cases, the first, second, third, and fourth passive radiator diaphragms all vibrate along a common vibration axis.

In certain cases, each of the first and second electro-acoustic transducers includes a transducer diaphragm, a motor, and a surround that couples the transducer diaphragm to the second passive radiator diaphragm, and the motors drive motion of the transducer diaphragms along the common vibration axis.

In some implementations, the movements of the third passive radiator diaphragm, the third enclosure, the fourth passive radiator diaphragm, and the second electro-acoustic transducer balance forces applied to the second enclosure due to movements of the first passive radiator diaphragm, the first enclosure, the second passive radiator diaphragm, and the first electro-acoustic transducer.

Implementations may include one of the above and/or below features, or any combination thereof.

DETAILED DESCRIPTION

Figure 1:
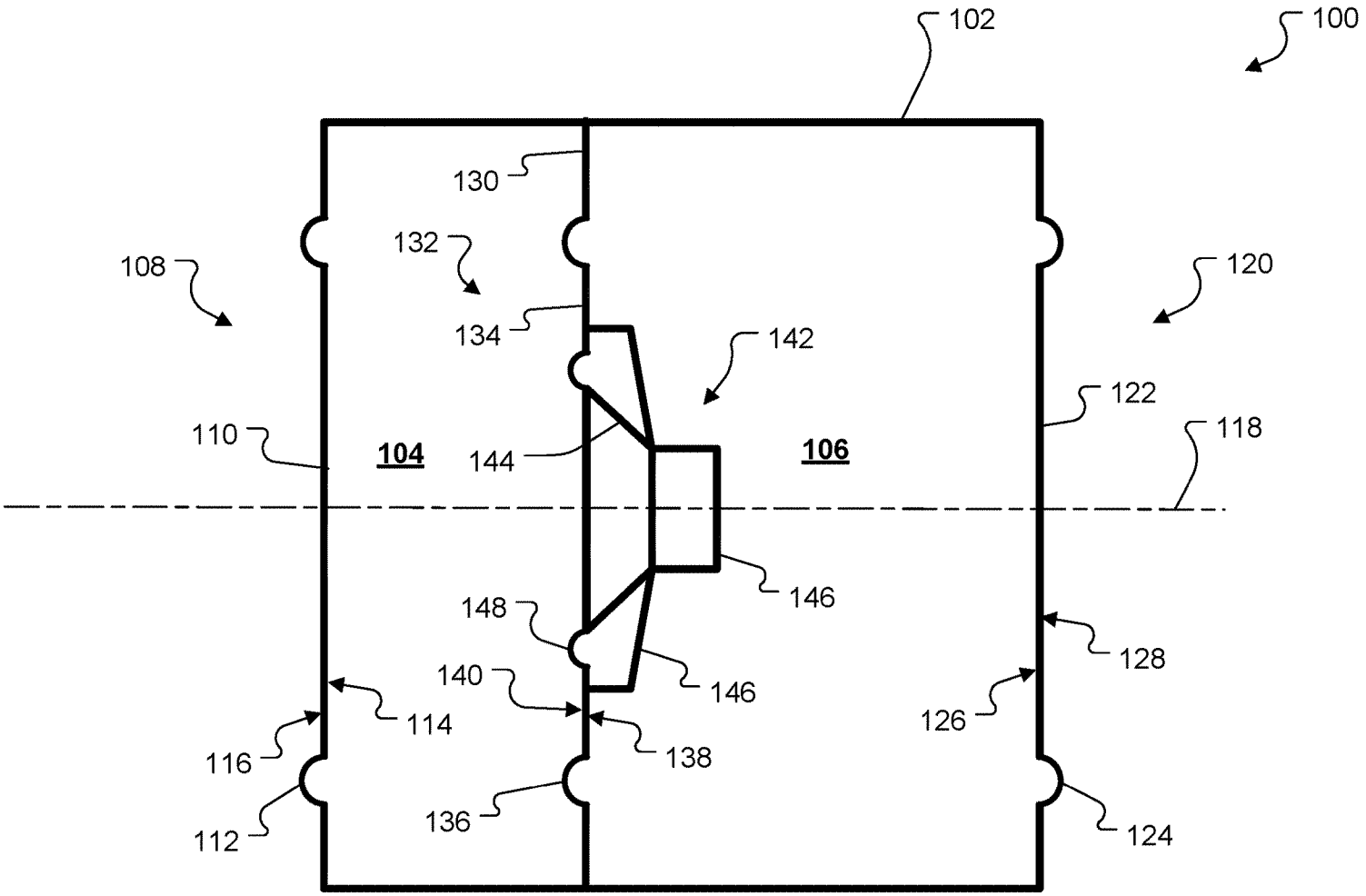
FIG. 1 is a cross-sectional view of an acoustic device that includes an electro-acoustic transducer that is secured to a passive radiator diaphragm.

Referring to FIG. 1, an acoustic device 100, includes an enclosure 102 which defines a first acoustic cavity 104 and a second acoustic cavity 106. Each of the first and second acoustic cavities 104, 106 are substantially airtight. A first passive radiator 108 closes one open side of the enclosure 102. The first passive radiator 108 includes a first passive radiator diaphragm 110 which is coupled to the enclosure 102 by a first suspension element 112. The first suspension element 112 is a type of suspension element known in the art and may be a single roll element as shown, or may have another configuration as is known in the art, such as a double roll configuration. The first passive radiator diaphragm 110 has a rear surface 114 which is exposed to the first acoustic cavity 104, and a front surface 116 which is open to the outside of the enclosure 102 such that it is able to radiate sound from the enclosure 102. The first passive radiator diaphragm 110 is constructed and arranged to vibrate in and out relative to the enclosure 102 along a vibration axis 118.

The acoustic device 100 also includes a second passive radiator 120 which closes the opposing side of the enclosure 102 from the first passive radiator 108. The second passive radiator 120 includes a second passive radiator diaphragm 122 which is coupled to the enclosure 102 by a second suspension element 124, which allows the second passive radiator diaphragm 122 to vibrate in an out relative to the enclosure 102 along the vibration axis 118. The second passive radiator diaphragm 122 includes a rear surface 126 which is exposed to the second acoustic cavity 106, and an front surface 128 which is exposed to the outside of the enclosure 102 so that it is able to radiate sound from the enclosure 102.

The enclosure 102 includes a dividing baffle 130 to which a third passive radiator 132 is mounted. The third passive radiator 132 closes an opening provided in the dividing baffle 130, thereby separating the first and second acoustic cavities 104, 106. The third passive radiator 132 includes a third passive radiator diaphragm 134 which is coupled to the enclosure 102 by a third suspension element 136, which allows the third passive radiator diaphragm 134 to vibrate relative to the enclosure 102 along the vibration axis 118. The third passive radiator diaphragm 134 includes a rear surface 138 which is exposed to the second acoustic cavity 106, and a front surface 140 which is exposed to the first acoustic cavity 104.

An electro-acoustic transducer 142 is mounted to the third passive radiator diaphragm 134 such that the electro-acoustic transducer 142 moves when the third passive radiator diaphragm 134 vibrates. The electro-acoustic transducer 142 can be any known type of active acoustic transducer. In this non-limiting example, the electro-acoustic transducer 142 includes a transducer diaphragm 144, a motor 146, a basket 147, and a surround 148. The surround 148 couples the transducer diaphragm 144 to the third passive radiator diaphragm 134, and the motor 146 drives motion of the transducer diaphragm 144, along the vibration axis 118, relative to the third passive radiator diaphragm 134. The surround 148 does not move at the tuning frequency of the enclosure 102. Therefore the electro-acoustic transducer 142 is part of the third passive radiator 132, and can be operated via audio signals.

As the electro-acoustic transducer 142 is operated it creates pressure changes in the first and second acoustic cavities 104, 106, which cause the first and second passive radiators 108, 120 to move in and out and thus radiate sound from the acoustic device 100. In this arrangement, the mass of the third passive radiator diaphragm 134 that is required in order to tune the enclosure 102 is accomplished fully or at least in part with the electro-acoustic transducer 142.

This arrangement enables acoustic energy from both sides of the transducer to be used for driving the first and second passive radiators 108, 120 for enhanced low frequency output. The mounting of the electro-acoustic transducer 142 on the third passive radiator 132 allows for motion of the third passive radiator 132 and the electro-acoustic transducer 142 to help balance forces applied to the enclosure 102 by the motion of the first and second passive radiators 108, 120. An alternative approach to a force balanced acoustic device could include a transducer that is fixedly mounted on a dividing baffle between a pair of acoustic cavities with a pair of force balanced passive radiators arranged on either side of the transducer. Such an arrangement would result in a total of four passive radiators. In contrast, the mounting of the electro-acoustic transducer 142 on the third passive radiator 134, as in the implementation illustrated in FIG. 1, eliminates the need for a fourth passive radiator for balance. Consequently, the present arrangement can provide for a less massive acoustic device than would be the case if the electro-acoustic transducer was fixedly mounted on the dividing baffle.

Also, some prior art acoustic devices which incorporate opposed passive radiators are designed such that the masses of those opposed passive radiators are equal. Applying the same design constraints to the present arrangement would require that the first and second passive radiator diaphragms would each need to have mass added to it to match the mass of the diaphragm that carries the transducer. However, this disclosure is based, at least in part, on the realization that such mass balancing is not necessary and that the acoustic device 100 will be force balanced so long as the following two equations, equations 1 and 2, are met.

$$A_{eff1}=A_{eff2}=A_{eff3} \quad \text{(eq. 1); and}$$

$$k_{eff1}/m_{eff1}=k_{eff2}/m_{eff2}=k_{eff3}/m_{eff3} \quad \text{(eq. 2)}$$

where, $A_{eff1}$=is the effective radiating area of the first passive radiator. The effective radiating area of a passive radiator as it vibrates can be determined by mounting the structure to a known closed volume, moving the structure in and out, and detecting pressure changes in the closed volume. The effective area can then be determined relative to the stroke.

$A_{eff2}$=is the effective radiating area of the second passive radiator.

$A_{eff3}$=is the effective radiating area of the third passive radiator, inclusive of the electro-acoustic transducer. I.e., the effective radiating area of the electro-acoustic transducer contributes to the effective radiating area of the third passive radiator.

$k_{eff1}$=is the effective stiffness of the first suspension element 112 acting on the first passive radiator.

$k_{eff2}$=is the effective stiffness of the second suspension element 124 acting on the second passive radiator.

$k_{eff3}$=is the effective stiffness of the third suspension element 136 acting on the third passive radiator.

$m_{eff1}$=is the effective mass of the first passive radiator.

$m_{eff2}$=is the effective mass of the second passive radiator.

$m_{eff3}$=is the effective mass of the third passive radiator. In the example illustrated in FIG. 1, the mass of the transducer 142 contributes to the effective mass ($m_{eff3}$) of the third passive radiator, such that $m_{eff3}$ consists essentially of the combined masses of the electro-acoustic transducer 142 and the third passive radiator diaphragm 134.

Thus, so long as the effective areas of all three passive radiators are substantially equal, and the ratio of stiffness to mass for all three passive radiators are substantially equal, the acoustic device will be force balanced across all frequencies. This force balancing helps to ensure that the enclosure 102 itself does not vibrate when resting or mounted on a surface where vibrations could cause unwanted sounds that interfere with the desired output.

Consequently, the effective masses of the first, second, and third passive radiators need not be the same, and, in cases where the effective mass are not the same, the lighter passive radiator(s) will move more than the heavier passive radiators, and thus will contribute more to the acoustic output. In the example illustrated in FIG. 1, the assembly consisting of the third passive radiator 132 and the electro-acoustic transducer 142 is the heavier structure and will thus move less that the first and second passive radiators 108, 120. Without limiting the generality of the foregoing, the effective mass of the third passive radiator 132 (including the mass of the transducer 142) may be in the range of from about two to about six times greater than that of either one of the first and second passive radiators 108, 120.

Figure 2:
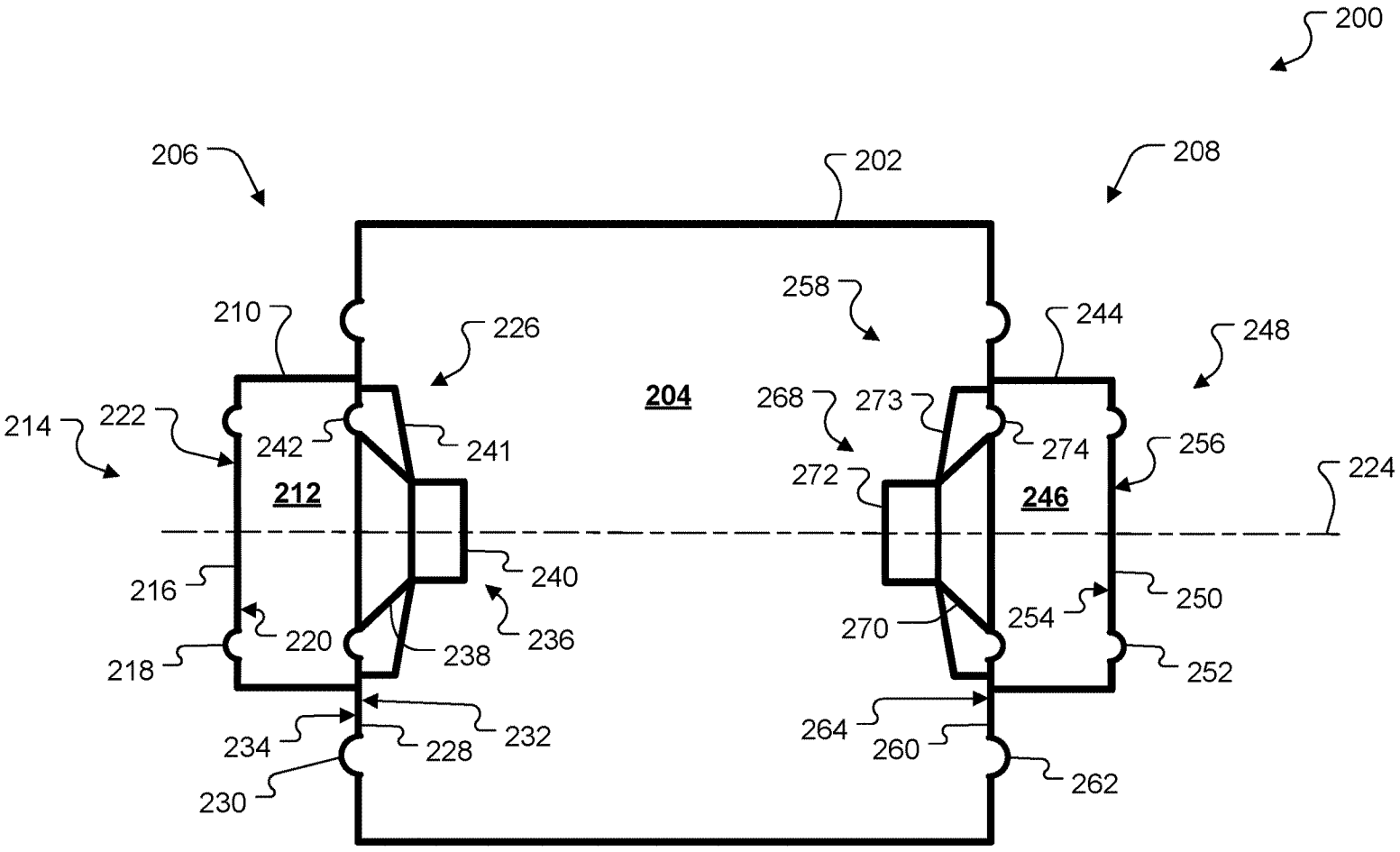
FIG. 2 is another example of a cross-sectional view of an acoustic device that includes an electro-acoustic transducer that is secured to a passive radiator diaphragm.

FIG. 2 illustrates another implementation of a force balanced acoustic device 200. Like the implementation of FIG. 1, the acoustic device 200 of FIG. 2 captures acoustic energy radiated from both sides of an electro-acoustic transducer in order to drive passive acoustic components (e.g., passive radiators) for enhanced low frequency output. Referring to FIG. 2, the acoustic device 200 includes a first enclosure 202 which defines a first acoustic cavity 204. A first acoustic assembly 206 closes one open side of the first enclosure 202, and a second acoustic assembly 208 closes the opposing side of the first enclosure 202. The first and second acoustic assemblies 206, 208 are symmetric meaning that both are made up of the same components and are arranged such that, when operated, the movements of their respective components balance the forces applied to the first enclosure 202 by the other one.

The first acoustic assembly 206 includes a second enclosure 210 which defines a second acoustic cavity 212, and a first passive radiator 214 which closes one open side of the second enclosure 210. The first passive radiator 214 includes a first passive radiator diaphragm 216 which is coupled to the second enclosure 210 by a first suspension element 218. The first passive radiator diaphragm 216 has a rear surface 220 which is exposed to the second acoustic cavity 212, and a front surface 222 which is open to the outside of the second enclosure 210. The first passive radiator diaphragm 216 is constructed and arranged to vibrate relative to the second enclosure 210 along a vibration axis 224.

The first acoustic assembly 206 also includes a second passive radiator 226 which closes an opposing side of the second enclosure 210 from the first passive radiator 214. The second passive radiator 226 includes a second passive radiator diaphragm 228 which is coupled to the first enclosure 202 by a second suspension element 230, which allows the second passive radiator diaphragm 228 to vibrate in and out relative to the first enclosure 202 along the vibration axis 224. The second enclosure 210 is fixedly mounted to the second passive radiator diaphragm 228 such that the second enclosure 210 moves when the second passive radiator diaphragm 228 vibrates, and such that there is no relative movement between the second enclosure 210 and the second passive radiator diaphragm 228. The second passive radiator diaphragm 228 includes a rear surface 232 which is exposed to the first acoustic cavity 204, and a front surface 234 which is exposed to the second acoustic cavity 212.

The first acoustic assembly 206 further includes a first electro-acoustic transducer 236 which is mounted to the second passive radiator diaphragm 228 such that that first electro-acoustic transducer 236 moves when the second passive radiator diaphragm 228 vibrates. The first electro-acoustic transducer 236 can be any known type of acoustic transducer. In this non-limiting example, the first electro-acoustic transducer 236 includes a first transducer diaphragm 238, a first motor 240, a first basket 241, and a first surround 242. The first surround 242 couples the first transducer diaphragm 238 to the second passive radiator diaphragm 228, and the first motor 240 drives motion of the first transducer diaphragm 238, along the vibration axis 224, relative to the second passive radiator diaphragm 228. As the first electro-acoustic transducer 236 is operated it creates pressure changes in the first and second acoustic cavities 204, 212 which cause the first and second passive radiators 214, 226 to move in and out.

As mentioned above, the second acoustic assembly 208 consists of essentially the same components as the first acoustic assembly 206. In that regard, the second acoustic assembly 208 includes a third enclosure 244 which defines a third acoustic cavity 246*y*, and a third passive radiator 248 which closes one open side of the third enclosure 244. The third passive radiator 248 includes a third passive radiator diaphragm 250 which is coupled to the third enclosure 244 by a third suspension element 25. The third passive radiator diaphragm 250 has a rear surface 254 which is exposed to the third acoustic cavity 246, and a front surface 256 which is open to the outside of the third enclosure 244. The third passive radiator diaphragm 250 is constructed and arranged to vibrate relative to the third enclosure 244 along the vibration axis 224.

The second acoustic assembly 208 also includes a fourth passive radiator 258 which closes an opposing side of the third enclosure 244 from the third passive radiator 248. The fourth passive radiator 258 includes a fourth passive radiator diaphragm 260 which is coupled to the first enclosure 202 by a fourth suspension element 262, which allows the fourth passive radiator diaphragm 260 to vibrate in and out relative to the first enclosure 202 along the vibration axis 224. The third enclosure 244 is fixedly mounted to the fourth passive radiator diaphragm 260 such that the third enclosure 244 moves when the fourth passive radiator diaphragm 260 vibrates, and such that there is no relative movement between the third enclosure 244 and the fourth passive radiator diaphragm 260. The fourth passive radiator diaphragm 260 includes a rear surface 264 which is exposed to the first acoustic cavity 204, and a front surface 266 which is exposed to the third acoustic cavity 246.

The second acoustic assembly 208 further includes a second electro-acoustic transducer 268 which is mounted to the fourth passive radiator diaphragm 260 such that that second electro-acoustic transducer 268 moves when the fourth passive radiator diaphragm 260 vibrates. The second electro-acoustic transducer 268 can be any known type of acoustic transducer. In this non-limiting example, the second electro-acoustic transducer 268 includes a second transducer diaphragm 270, a second motor 272, a second basket 273, and a second surround 274. The second surround 274 couples the second transducer diaphragm 270 to the fourth passive radiator diaphragm 260, and the second motor 272 drives motion of the second transducer diaphragm 270, along the vibration axis 224, relative to the fourth passive radiator diaphragm 260.

As the second electro-acoustic transducer 268 is operated it creates pressure changes in the first and third acoustic cavities 204, 246 which cause the third and fourth passive radiators 248, 258 to move in and out. This motion of the second acoustic assembly 208 is opposite to that of the first acoustic assembly 206, and, since the assemblies are driven with the same audio signal and consist of the same components, the forces that each applies the first enclosure 202 will be equal and opposite effectively negating each other and thereby inhibiting vibration of the first enclosure 202 when it is rested on a surface. This, this force balancing helps to ensure that the first enclosure 202 itself does not vibrate when resting or mounted on a surface where vibrations could cause unwanted sounds that interfere with the desired output.

Still other implementations are possible. For example, while FIG. 2 illustrates an implementation that includes a pair of symmetric acoustic assemblies such symmetry is not necessary so long as the forces applied to the enclosure (e.g., the forces applied at either side of the first enclosure 202 in FIG. 2) balance each other.

A number of implementations have been described. Nevertheless, it will be understood that additional modifications may be made without departing from the scope of the inventive concepts described herein, and, accordingly, other implementations are within the scope of the following claims.

What is claimed is:

1. An acoustic device, comprising:

a first acoustic cavity that is substantially air tight;

a second acoustic cavity that is substantially air tight;

a first passive radiator comprising a first passive radiator diaphragm having a rear surface which is exposed to the first acoustic cavity;

a second passive radiator comprising a second passive radiator diaphragm having a front surface which is exposed to the first acoustic cavity, and a rear surface which is exposed to the second acoustic cavity; and a first electro-acoustic transducer supported on the second passive radiator diaphragm, wherein the first electro-acoustic transducer is arranged such that a first radiating surface of the first electro-acoustic transducer radiates acoustic energy into the first acoustic chamber and a second radiating surface of the first electro-acoustic transducer radiates acoustic energy into the second acoustic chamber.

2. The acoustic device of claim 1, further comprising an enclosure that defines the first and second acoustic cavities.

3. The acoustic device of claim 2, further comprising a third passive radiator comprising a third passive radiator diaphragm having a rear surface which is exposed to the second acoustic cavity.

4. The acoustic device of claim 3, wherein the first passive radiator has a first effective radiating area; the second passive radiator has a second effective radiating area, inclusive of an effective radiating area of the electro-acoustic transducer; and the third passive radiator has a third effective radiating area; and wherein the first, second, and third effective radiating areas are substantially the same.

5. The acoustic device of claim 4, wherein the first passive radiator diaphragm is coupled to the enclosure by a first suspension element, the second passive radiator diaphragm is coupled to the enclosure by a second suspension element, and the third passive radiator diaphragm is coupled to the enclosure by a third suspension element.

6. The acoustic device of claim 4, wherein the first passive radiator diaphragm, the second passive radiator diaphragm, and the third passive radiator diaphragm are each configured to vibrate, relative to the enclosure, along a common vibration axis.

7. The acoustic device of claim 6, wherein the first electro-acoustic transducer includes a transducer diaphragm, a motor, and a surround that couples the transducer diaphragm to the second passive radiator diaphragm, and wherein the motor drives motion of the transducer diaphragm, relative to the second passive radiator diaphragm, along the common vibration axis.

8. The acoustic device of claim 2, wherein the first passive radiator diaphragm and the second passive radiator diaphragm are each configured to vibrate, relative to the enclosure, along a common vibration axis.

9. The acoustic device of claim 8, wherein the first electro-acoustic transducer includes a transducer diaphragm, a motor, and a surround that couples the transducer diaphragm to the second passive radiator diaphragm, and wherein the motor drives motion of the transducer diaphragm, relative to the second passive radiator diaphragm, along the common vibration axis.

10. The acoustic device of claim 1, further comprising a first enclosure which defines the first acoustic cavity, and a second enclosure that defines the second acoustic cavity, wherein the first enclosure is mounted to the second passive radiator such that the first enclosure moves when the second passive radiator diaphragm vibrates.

11. The acoustic device of claim 10, wherein the first passive radiator diaphragm is coupled to the first enclosure by a first suspension element such that the second passive radiator diaphragm can vibrate relative to the first enclosure, and the second passive radiator diaphragm is coupled to the second enclosure by a second suspension element such that the second passive radiator diaphragm can vibrate relative to the second enclosure.

12. The acoustic device of claim 11, wherein the first passive radiator diaphragm, and the second passive radiator diaphragm both vibrate along a common vibration axis.

13. The acoustic device of claim 12, wherein the first electro-acoustic transducer includes a transducer diaphragm, a motor, and a surround that couples the transducer diaphragm to the second passive radiator diaphragm, and wherein the motor drives motion of the transducer diaphragm, relative to the second passive radiator diaphragm, along the common vibration axis.

14. The acoustic device of claim 11, further comprising a third enclosure that defines the third acoustic cavity, wherein the third enclosure is mounted to the fourth passive radiator such that the third enclosure moves when the fourth passive radiator diaphragm vibrates.

15. An acoustic device, comprising:

a first acoustic cavity;

a second acoustic cavity;

a first passive radiator comprising a first passive radiator diaphragm having a rear surface which is exposed to the first acoustic cavity;

a second passive radiator comprising a second passive radiator diaphragm having a front surface which is exposed to the first acoustic cavity, and a rear surface which is exposed to the second acoustic cavity; and an electro-acoustic transducer supported on the second passive radiator diaphragm, wherein the electro-acoustic transducer is arranged such that a first radiating surface of the electro-acoustic transducer radiates acoustic energy into the first acoustic chamber and a second radiating surface of the electro-acoustic transducer radiates acoustic energy into the second acoustic chamber.

16. The acoustic device of claim 15, wherein the first passive radiator has a first effective radiating area and the second passive radiator has a second effective radiating area that is substantially equal to the first effective radiating area.

17. The acoustic device of claim 16, further comprising:

a first suspension element acting on the first passive radiator, the first suspension element having a first effective stiffness, the first passive radiator having a first effective mass; and a second suspension element acting on the second passive radiator, the second suspension element having a second effective stiffness, the second passive radiator having a second effective mass, wherein the ratio of the first effective stiffness to the first effective mass is substantially equal to the ratio of the second effective stiffness to the second effective mass.

18. The acoustic device of claim 15, further comprising:

a first suspension element acting on the first passive radiator, the first suspension element having a first effective stiffness, the first passive radiator having a first effective mass; and a second suspension element acting on the second passive radiator, the second suspension element having a second effective stiffness, the second passive radiator having a second effective mass, wherein the ratio of the first effective stiffness to the first effective mass is substantially equal to the ratio of the second effective stiffness to the second effective mass.

19. The acoustic device of claim 15, further comprising a third passive radiator comprising a third passive radiator diaphragm having a rear surface which is exposed to the second acoustic cavity.

20. The acoustic device of claim 19, wherein the first passive radiator has a first effective radiating area, the second passive radiator has a second effective radiating area, and the third passive radiator has a third effective radiating area, the first, second, and third effective radiating areas being substantially equal.

* * * * *